US008637813B2

(12) United States Patent
Van Berkel et al.

(10) Patent No.: US 8,637,813 B2
(45) Date of Patent: Jan. 28, 2014

(54) SYSTEM AND METHOD FOR LASER ASSISTED SAMPLE TRANSFER TO SOLUTION FOR CHEMICAL ANALYSIS

(75) Inventors: Gary J. Van Berkel, Clinton, TN (US); Vilmos Kertesz, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 12/896,018

(22) Filed: Oct. 1, 2010

(65) Prior Publication Data

US 2012/0080589 A1 Apr. 5, 2012

(51) Int. Cl.
*H01J 49/26* (2006.01)
*H01J 49/00* (2006.01)

(52) U.S. Cl.
USPC ..... 250/288; 250/282; 250/489

(58) Field of Classification Search
USPC ..... 250/288, 281–284, 489
See application file for complete search history.

(56) References Cited

U.S. PATENT DOCUMENTS

| | | | | |
|---|---|---|---|---|
| 4,726,487 | A | 2/1988 | Mitri | |
| 4,865,199 | A | 9/1989 | Zimmer | |
| 5,205,473 | A | 4/1993 | Coffin, Sr. | |
| 5,777,324 | A * | 7/1998 | Hillenkamp | 250/288 |
| 6,140,639 | A | 10/2000 | Gusev et al. | |
| 6,620,625 | B2 * | 9/2003 | Wolk et al. | 436/180 |
| 6,803,566 | B2 | 10/2004 | Van Berkel | |
| 6,864,480 | B2 | 3/2005 | Staats | |
| 7,525,105 | B2 | 4/2009 | Kovtoun | |
| 7,645,987 | B2 * | 1/2010 | Chang et al. | 250/288 |
| 7,718,958 | B2 | 5/2010 | Shiea et al. | |
| 7,910,881 | B2 * | 3/2011 | Nikolaev et al. | 250/288 |
| 8,067,730 | B2 * | 11/2011 | Vertes et al. | 250/288 |

(Continued)

FOREIGN PATENT DOCUMENTS

| | | |
|---|---|---|
| DE | 4200497 | 7/1993 |
| DE | 102004048380 | 4/2006 |

(Continued)

OTHER PUBLICATIONS

Becker et al., "Evidence of Near-Field Laser Ablation Inductively Coupled Plasma Mass Spectrometry (NF-LA-ICP-MS) at Nanometre Scale for Elemental and Isotopic Analysis on Gels and Biological Samples," Journal of Analytical Atomic Spectrometry, 2006, p. 19-25, vol. 21, The Royal Society of Chemistry.

(Continued)

*Primary Examiner* — David A Vanore
*Assistant Examiner* — Wyatt Stoffa
(74) *Attorney, Agent, or Firm* — Novak Druce Connolly Bove + Quigg LLP

(57) ABSTRACT

A system and method for laser desorption of an analyte from a specimen and capturing of the analyte in a suspended solvent to form a testing solution are described. The method can include providing a specimen supported by a desorption region of a specimen stage and desorbing an analyte from a target site of the specimen with a laser beam centered at a radiation wavelength (λ). The desorption region is transparent to the radiation wavelength (λ) and the sampling probe and a laser source emitting the laser beam are on opposite sides of a primary surface of the specimen stage. The system can also be arranged where the laser source and the sampling probe are on the same side of a primary surface of the specimen stage. The testing solution can then be analyzed using an analytical instrument or undergo further processing.

13 Claims, 16 Drawing Sheets

(56) References Cited

U.S. PATENT DOCUMENTS

| | | | | |
|---|---|---|---|---|
| 2002/0109085 | A1* | 8/2002 | Hillenkamp et al. | 250/288 |
| 2002/0168778 | A1 | 11/2002 | Andrien, Jr. et al. | |
| 2004/0023410 | A1 | 2/2004 | Stacey | |
| 2005/0116161 | A1 | 6/2005 | Hafeman et al. | |
| 2005/0178959 | A1 | 8/2005 | Lopez-Avila et al. | |
| 2005/0276937 | A1 | 12/2005 | Kosth | |
| 2007/0046934 | A1 | 3/2007 | Roy | |
| 2007/0138384 | A1 | 6/2007 | Keiser | |
| 2007/0224697 | A1 | 9/2007 | Park | |
| 2007/0295902 | A1* | 12/2007 | Shea et al. | 250/288 |
| 2008/0128614 | A1* | 6/2008 | Nikolaev et al. | 250/288 |
| 2008/0131949 | A1 | 6/2008 | Bortolin et al. | |
| 2008/0272294 | A1 | 11/2008 | Kovtoun | |
| 2008/0308722 | A1* | 12/2008 | Shiea | 250/281 |
| 2009/0121124 | A1 | 5/2009 | Schneider | |
| 2009/0253210 | A1 | 10/2009 | Kobold et al. | |
| 2009/0263440 | A1 | 10/2009 | Kendall | |
| 2009/0272892 | A1* | 11/2009 | Vertes et al. | 250/282 |
| 2010/0038529 | A1 | 2/2010 | Sato et al. | |
| 2010/0224013 | A1* | 9/2010 | Van Berkel et al. | 73/863.81 |
| 2011/0133077 | A1* | 6/2011 | Henion et al. | 250/288 |
| 2011/0220787 | A1* | 9/2011 | Shiea | 250/288 |
| 2011/0259205 | A1 | 10/2011 | Delorme | |
| 2011/0272571 | A1* | 11/2011 | Kenttamaa et al. | 250/282 |
| 2012/0119079 | A1 | 5/2012 | Ouyang et al. | |

FOREIGN PATENT DOCUMENTS

| | | |
|---|---|---|
| DE | 102006 056929 | 6/2008 |
| EP | 1252366 | 10/2002 |
| JP | 7 159293 A | 6/1995 |
| JP | 10148605 | 6/1998 |
| JP | 2003035671 | 2/2003 |
| JP | 2006059641 | 3/2006 |

OTHER PUBLICATIONS

Bohn et al., "Field Enhancement in Apertureless Near-Field Scanning Optical Microscopy," J. Opt. Soc. Am. A/vol. 18, No. 12/Dec. 2001, p. 2998-3006, Optical Society of America.

Chapter 2 "Liquid-Phase Pulsed Laser Ablation."

Chen et al., "The Irradiation Effect of a Nd-YAG Pulsed Laser on the CeO2 Target in the Liquid," Materials Letters, 2004, p. 337-341. vol. 58, Elsevier.

De Serio, M. et al. "Looking at the nanoscale: scanning near-field optical microscopy." Trends in Analytical Chemistry, vol. 22, No. 2, 2003.

Douglas et al., "Laser Ablation of a Sample in Liquid—LASIL," J. Anal. At. Spectrom., 2011, The Royal Society of Chemistry.

Dunn, Robert C., "Near-Field Scanning Optical Microscopy," Chem. Rev., 1999, p. 2891-2927, vol. 99.

Leung, et al., "Transmission Studies of Explosive Vaporization of a Transparent Liquid Film on an Opaque Solid Surface Induced by Excimer-Laser-Pulsed Irradiation," J. Appl. Phy., 1992, p. 2256-2263, vol. 72 No. 6.

M. Meunier et al. , "Laser Processing Laboratory. Colloidal metal nanoparticles synthesized by femtosecond laser ablation in liquids." http://LPL.phys.polymt1.ca. Retrieved Mar. 8-10, 2005.

Muravitskaya et al., "Laser Ablation in Liquids as a New Technique of Sampling in Elemental Analysis of Solid Materials," Spectrochimica Acta Part B, 2009, p. 119-125, vol. 64, Elsevier B.V.

Novotny et al., "Near-Field Optical Microscopy and Spectroscopy with Pointed Probes," Annu. Rev. Phys. Chem., 2006, p. 303-31, vol. 57, Annual Reviews,.

Reedy, M. Praveen, "Solid Dispersions" last visited Oct. 19, 2011 and presented at http://www.authorstream.com/Presentation/robin_vinnu-623593-solid-dispersions/(video).

Schmid, Thomas et al., "Methods for Modecular Nanoanalysis." CHIMIA 2006, 60, No. 11, pp. 783-788.

Schmidtz et al., "Towards Nanoscale Molecular Analysis at Atmospheric Pressure by a Near-Field Laser Ablation Ion Trap/Time-of-Flight Mass Spectrometer," Analytical Chemistry, 2008, p. 6537-6544, vol. 80 No. 17.

Stöckle et al., "Nanoscale Atmospheric Pressure Laser Ablation-Mass Spectrometry," Analytical Chemistry, 2001, p. 1399-1402, vol. 73-7, American Chemical Society.

Tsuji et al., "Microsecond-Resolved Imaging of Laser Ablation at Solid-Liquid Interface: Investigation of Formation Process of Nano-Size Metal Colloids," Applied Surface Science, 2004, p. 365-371, vol. 229, Elsevier B.V.

Yang, G.W., "Laser Ablation in Liquids: Applications in the Synthesis of Nanocrystals," Progress in Materials Science, 2007, p. 648-698, vol. 52, Elsevier.

Yasuo Lida, et al. "Laser ablation in a liquid Medium as a Technique for Solid Sampling." Journal of Analytical Atomic Spectrometry, Oct. 1991, vol. 6. pp. 541-544.

Yasushi Inouye., "Apertureless Metallic Probes for Near-Field Microscopy." Near-Field Optics and Surface Plasmon Polaritons, Topics Appl. Phys. 81, 29-48 (2001).

Yavas et al., "Optical Reflectance and Scattering Studies of Nucleation and Growth of Bubbles at a Liquid-Solid Interface induced by Pulsed Laser Heating," Physical Review Letters. 1993, p. 1830-1833, vol. 70 No. 17, The American Physical Society.

Yavas, O. et al., "Bubble nucleation and pressure generation during laser cleaning surfaces," Appl. Phys. A 64, 331-339 (1997).

Zeisel et al., "Pulsed Laser-Induced Desorption and Optical Imaging on a Nanometer Scale With Scanning Near-Field Microscopy Using Chemically Etched Fiber Tips," Appl. Phys. Letter 1996, p. 2491-2. vol. 68 No. 18, Amer. Inst. of Physics.

Zijie Yan, et al. "Hollow nanoparticle generation on laser-induced cavitation bubbles via hobble interface pinning." Applied Physical Letters, 2010, p. 124106-1-3, vol. 97, Amer. Inst. of Physics.

Zoriy et al., "Possibility of Nano-Local Element Analysis by Near-Field Laser Ablation Inductively Coupled Plasma Mass Spectrometry (LA-ICP-MS): New Experimental Arrangement and First Application," International Journal of Mass Spectrometry, 2008, p. 151-155, vol. 273, Elsevier B.V.

Eskin, "Just a day at the beach," Chicago Tribune Jun. 2, 2002.

Final Office Action issued on Jan. 17, 2013 in U.S. Appl. No. 13/102,606. (23 pages).

Non Final Office Action issued on Jul. 17, 2012 in U.S. Appl. No. 13/102,606. (26 pages).

* cited by examiner

SYSTEM AND METHOD FOR LASER ASSISTED SAMPLE TRANSFER TO SOLUTION FOR CHEMICAL ANALYSIS

STATEMENT REGARDING FEDERALLY SPONSORED RESEARCH

This invention was made with government support under Contract No. DE-AC05-00OR22725 awarded by the U.S. Department of Energy. The government has certain rights in this invention.

FIELD OF THE INVENTION

This invention is drawn to systems and methods for surface sampling in general, and for laser assisted sample transfer to solution for mass spectrometric analysis in particular.

BACKGROUND OF THE INVENTION

Advances in analytical technology have pushed the limits of human understanding of chemical and physical phenomena. New tools create the opportunity for the new discoveries. Currently available techniques, such as laser desorption techniques, allow analysis of the chemical composition of surfaces at the micron level. However, conventional laser desorption techniques can be limited in their ability to desorb and ionize analytes present at the surface being analyzed. Thus, there is room for improvement in surface extraction technology.

SUMMARY OF THE INVENTION

A method and system for laser assisted transfer of an analyte to a solution for analyzing the analyte is described. The system can include a specimen stage having a desorption region that is transparent to a radiation wavelength (λ); a sampling probe for suspending a solvent above the specimen stage; and a laser source for emitting a laser beam centered at the radiation wavelength (λ) toward the specimen stage. The laser source and the sampling probe can be on opposite sides of a primary surface of the specimen stage, i.e., in a transmission geometry.

The system can also include an analytical instrument for determining a chemical composition of an analyte in a testing solution comprising the solvent. The solvent can be in fluid communication with the analytical instrument. The analytical instrument can be a mass spectrometer, an ionization source, a separation method, or a combination thereof.

The system can also include a stepper mechanism configured to sequentially direct the laser beam at a plurality of target sites of a specimen supported by the specimen stage. The stepper mechanism can also be configured to provide relative motion between the specimen stage and the sampling probe.

The system can also include a testing device, which can be an analytical instrument or a device for processing the sample prior to evaluation with an analytical instrument. The stepper mechanism can be configured (i) to sequentially position the sampling probe to capture an analyte that is laser desorbed from each of a plurality of target sites with a suspended solvent to form a testing solution and (ii) to discharge the testing solution to the testing device. The testing solution is discharged from a distal end of said sampling probe.

The sampling probe can be a dual capillary sampling probe. For example, the sampling probe can include an outer capillary tube, and an inner capillary tube disposed co-axially within the outer capillary tube, where the inner and outer capillary tubes define a solvent capillary and a sampling capillary in fluid communication with one another at a distal end of the probe.

The invention also includes a system for extracting an analyte from a specimen that includes a specimen stage; a sampling probe configured to suspend a solvent to form an uninterrupted meniscus above said specimen stage; a laser source for emitting a laser beam centered at a radiation wavelength (λ) toward said specimen stage; and a stepper mechanism. The stepper mechanism can be configured to provide relative motion between the laser source and the specimen stage. The laser source and the sampling probe can both be on a primary surface side of the specimen stage. Alternately, the laser source and the sampling probe can be on opposite sides of a primary surface of the specimen stage.

A method of extracting an analyte from a specimen is also described. The method can include providing a specimen supported by a desorption region of a specimen stage; desorbing an analyte from a target site of a specimen with a laser beam centered at a radiation wavelength (λ); and capturing the desorbed analyte with a suspended solvent to form a testing solution. The desorption region can be transparent to the radiation wavelength (λ), and both the specimen and the laser source emitting the laser beam can be on opposite sides of a primary surface of the specimen stage. The method can also include a chemical composition of the desorbed analyte. Finally, the desorbing, capturing and analyzing steps can be repeated for each of a plurality of target sites of the specimen.

The invention also includes a method of analyzing a chemical composition of a specimen that includes desorbing an analyte from a target site of a specimen with a laser beam centered at a radiation wavelength (λ); capturing the desorbed analyte with a solvent suspended in the form of an uninterrupted meniscus above the specimen to form a testing solution; dispensing the testing solution to a testing device; automatically repositioning the specimen, the laser beam, or both; and repeating the desorbing, capturing and dispensing steps for a second target site of the specimen. The method can also include analyzing a chemical composition of the desorbed analyte. For example, the dispensing step can be into an analytical device.

BRIEF DESCRIPTION OF THE DRAWINGS

A fuller understanding of the present invention and the features and benefits thereof will be obtained upon review of the following detailed description together with the accompanying drawings, in which:

FIG. 11 shows intensity versus time data for a rhodamine 6G sample on glass obtained using a transmission geometry laser desorption system according to the invention.

DETAILED DESCRIPTION OF THE INVENTION

Figure 1:
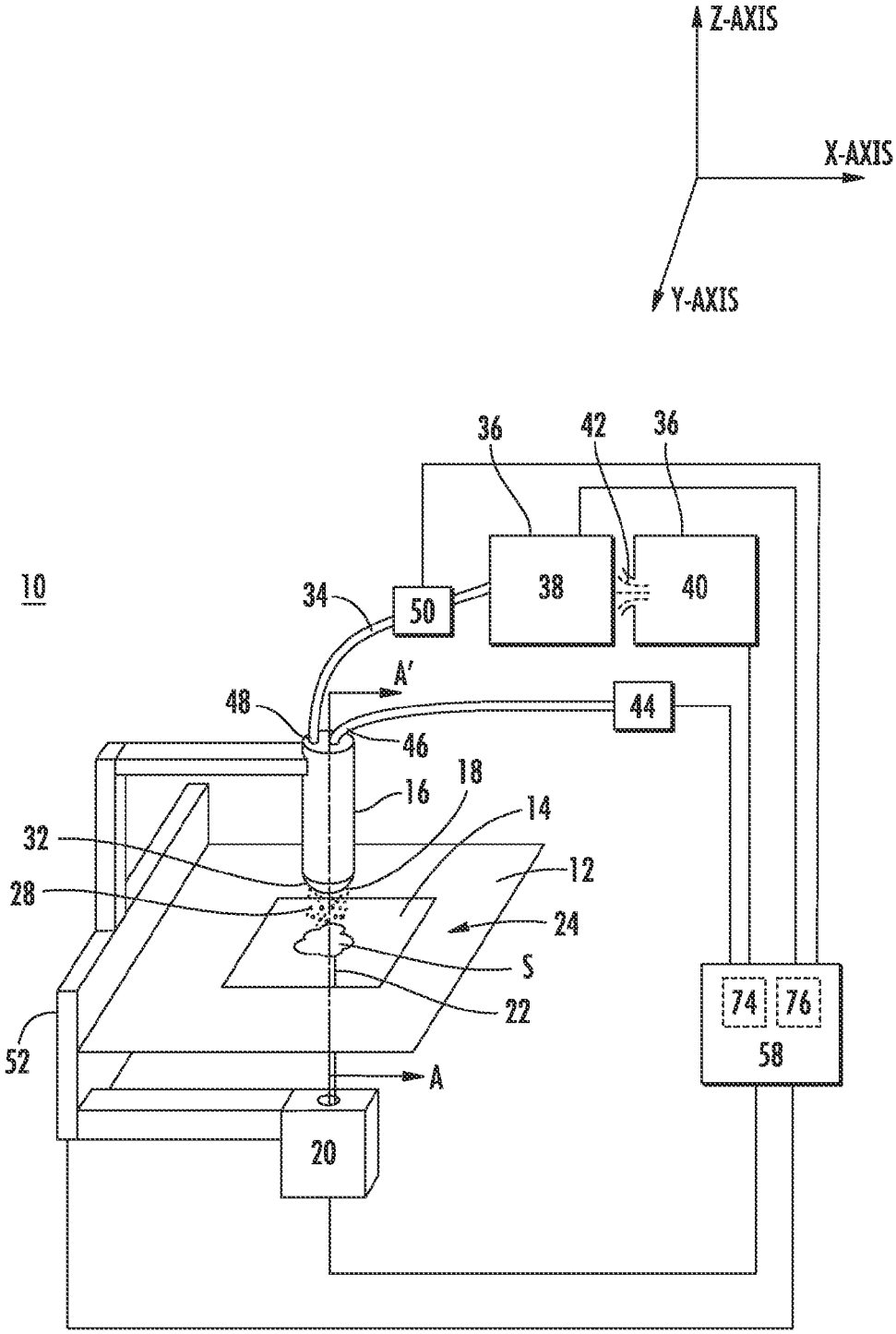
FIG. 1 is a schematic of a transmission geometry laser desorption system according to the invention.

The present invention is directed to systems and methods for desorption sampling and chemical analysis of a specimen. In particular, systems and methods for producing testing solutions of an analyte obtained through laser desorption of a specimen are described. The systems and methods described herein can also provide mapping the chemical composition of the specimen. It is noted that like and corresponding elements mentioned herein and illustrated in the figures are generally referred to by the same reference numeral. It is also noted that proportions of various elements in the accompanying figures are not drawn to scale to enable clear illustration of elements having smaller dimensions relative to other elements having larger dimensions.

As shown in the Figures, the system 10 for extracting an analyte from a specimen (S) can include a specimen stage 12 including a desorption region 14 that is transparent to a radiation wavelength (λ), a sampling probe 16 for suspending a solvent 18 above the specimen stage 12, and a laser source 20 for emitting a laser beam 22 centered at the radiation wavelength (λ) toward the specimen stage 12 or, more particularly, toward the desorption region 14 and a target site 26 of the specimen (S).

Figure 2:
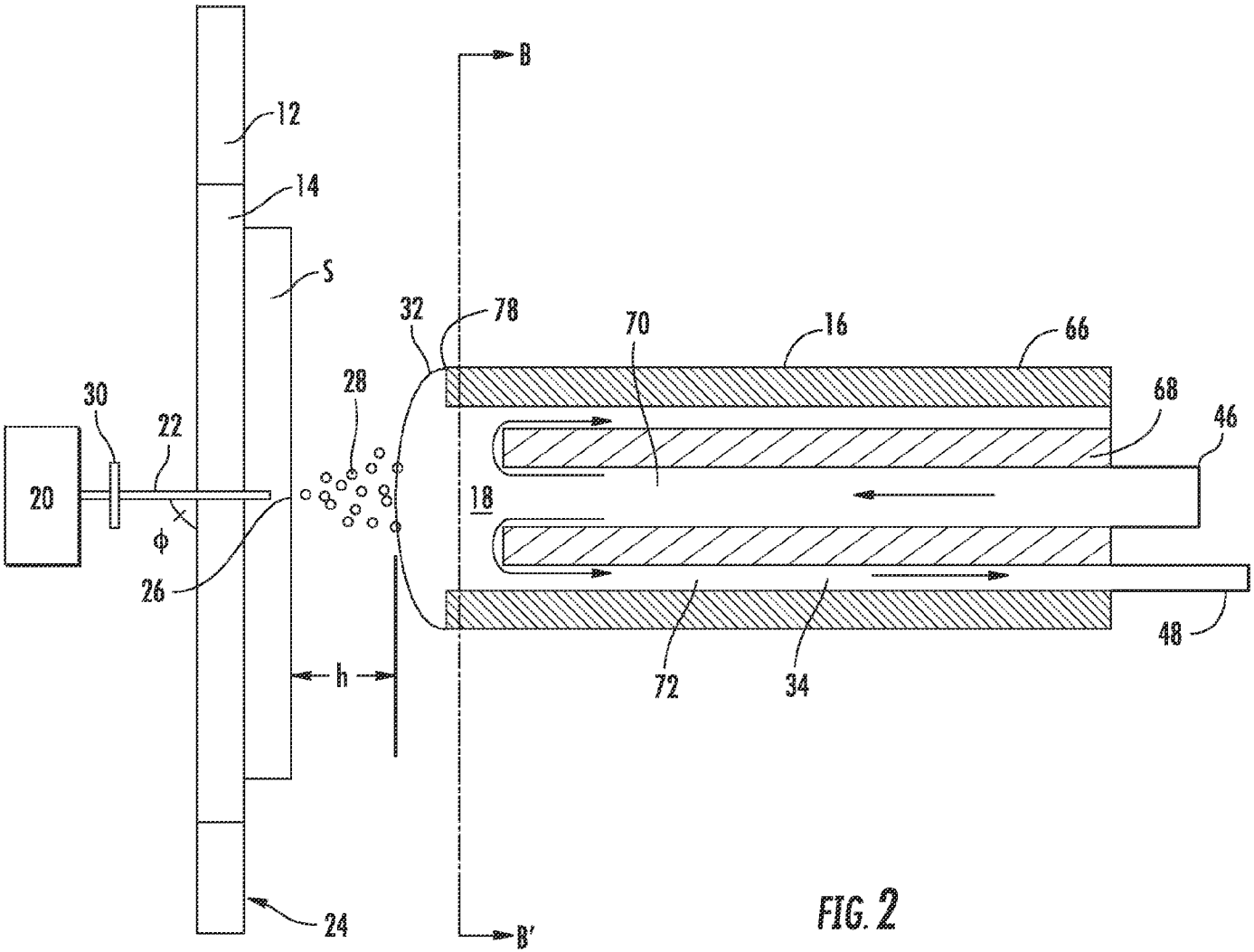
FIG. 2 is a cross-sectional view of the laser desorption system of FIG. 1 taken along cut line A-A', where the sampling probe has a dual capillary configuration.
Figure 3:
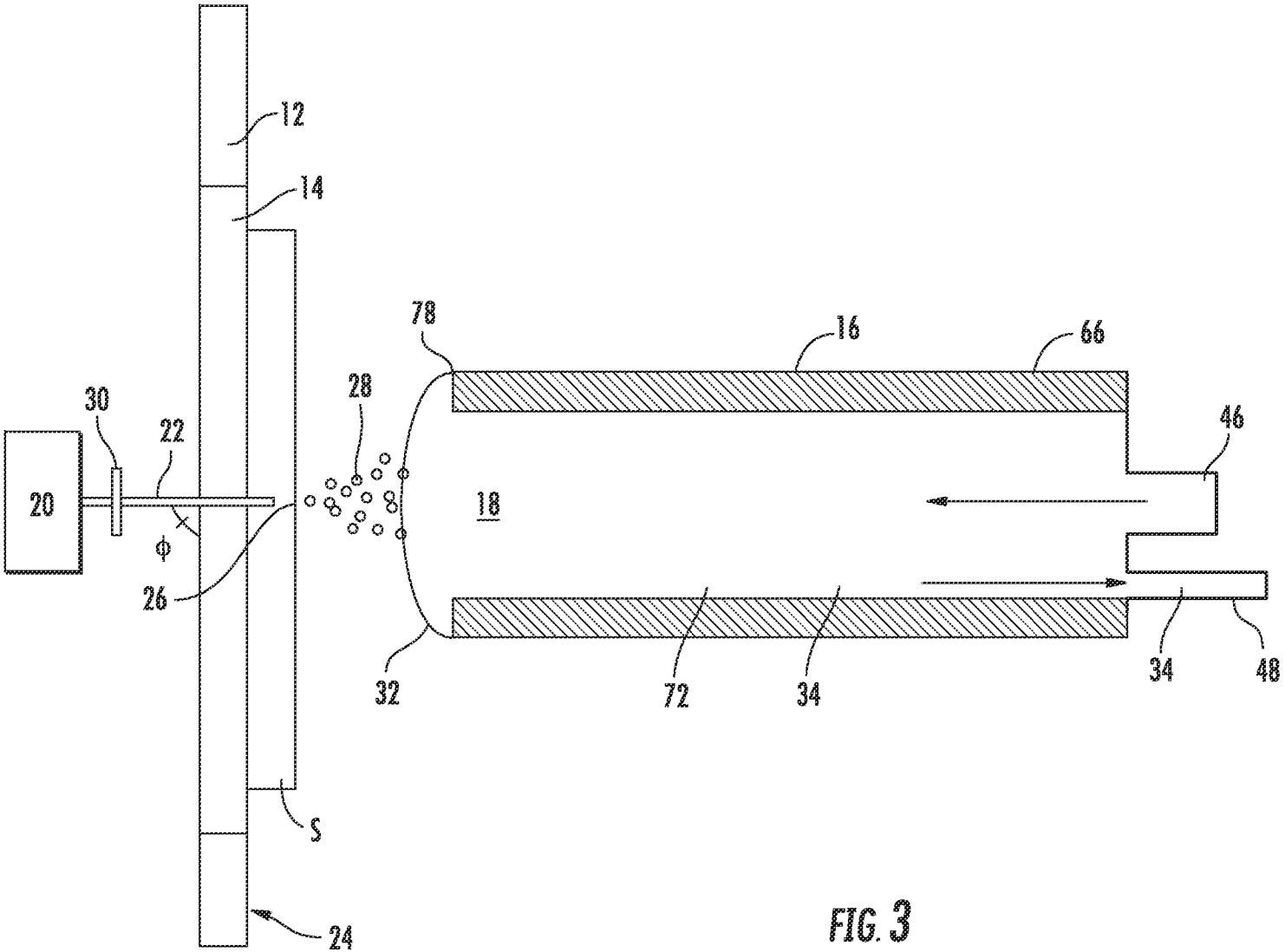
FIG. 3 is a cross-sectional view of the laser desorption system of FIG. 1 taken along cut line A-A', where the sampling probe has a single capillary configuration.

As shown in FIGS. 1-3, the laser source 20 and the sampling probe 16 can be on opposite sides of a primary surface 24 of the specimen stage 12. As shown in FIGS. 2 & 3, where the laser source 20 and the sampling probe 16 are on opposite sides of the primary surface 24, the incident angle (ϕ) of the laser beam 22 can be between 45 and 135°, or between 70 and 110°, or between 80 and 100°, or between 85 and 95°, or between 88 and 92°. As used herein, "primary surface" refers to the major surface of the specimen stage 12 that is proximate the sampling probe 16.

Figure 6:
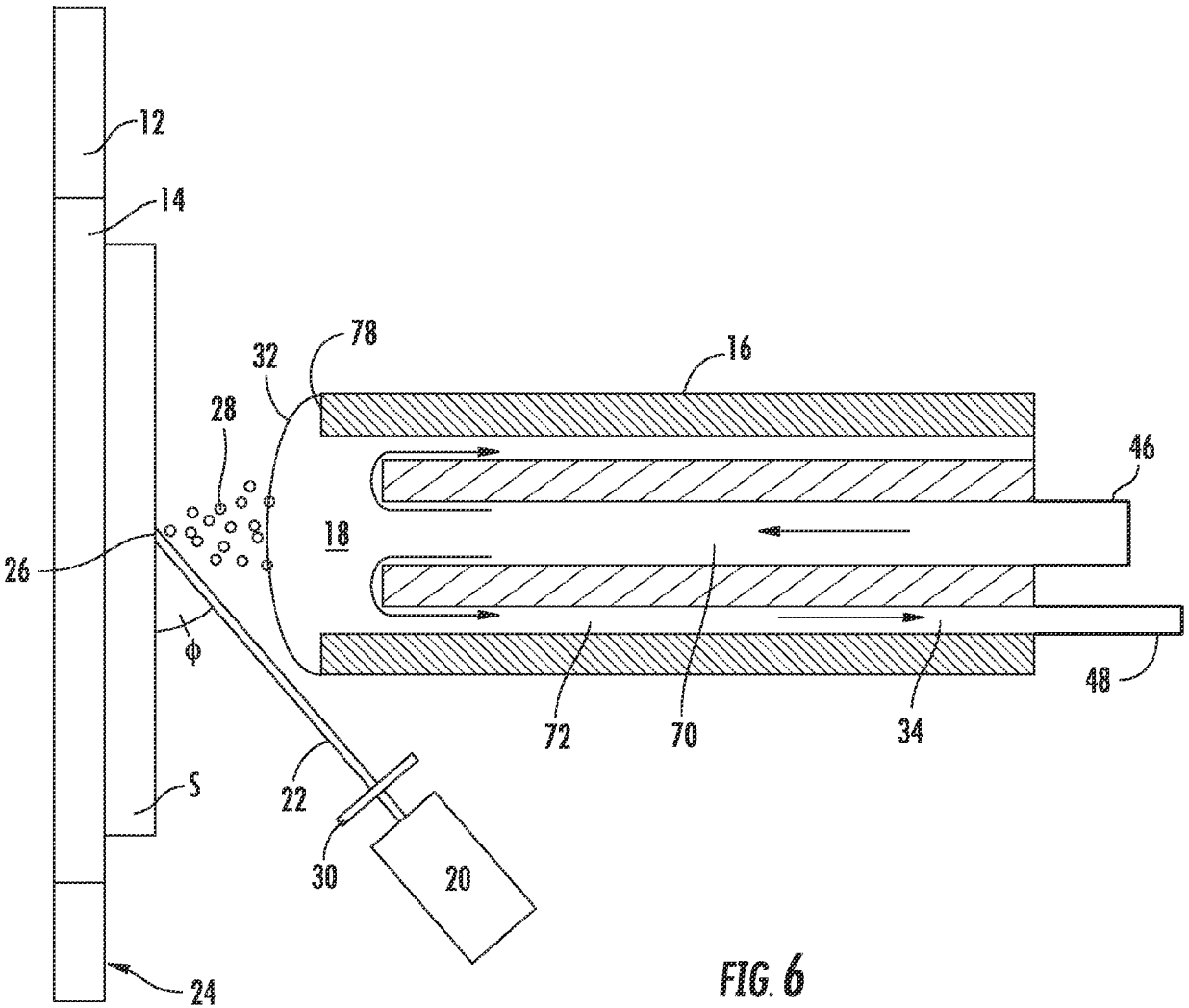
FIG. 6 is a cross-sectional view of the laser desorption system of FIG. 5 taken along cut line C-C', where the sampling probe has a dual capillary configuration.

As used herein, "desorption region" refers to that region of the specimen stage 12 where specimens to be sampled are positioned. In one exemplary specimen stage 12, the desorption region 14 can be an opening designed to receive a mounted specimen, e.g., a specimen mounted on a glass or quartz slide. In another exemplary specimen stage 12, which is shown in FIGS. 2 & 6, the desorption region 14 can be a glass or quartz insert that is coupled to the specimen stage 12. Alternately, the entire specimen stage 12 can be a desorption region.

As used herein, "transparent" refers to a material that transmits all or nearly all of a given wavelength of electromagnetic radiation, with little or no diffuse transmission, absorption or reflection. For example, the combined amount of diffuse transmission, absorption and reflection of a material that is transparent at a given wavelength can be 10% or less, 5% or less, 2.5% or less, 1% or less, or 0.1% or less for the given wavelength.

Regardless of where the laser source 20 is positioned with respect to the specimen stage 12, the laser beam 22 can be directed toward the desorption region 14 for a sufficient duration to evolve a desorbed analyte 28 from the target site 26. Where the desorbed analyte 28 is a gaseous analyte, the desorbed analyte 28 can be volatized molecules from the target site 26, pyrolytic decomposition products of molecules from the target site 26, or both. A unique feature this technique is the ability to use the laser desorption to desorb intact molecular species of both large molecules, e.g., >10,000 Da or 100,000 Da, or 1,000,000 Da, and small molecules, e.g., <10,000 Da, <1,000 Da, or even elemental ions.

As used herein, "desorbed analyte" refers to any gaseous, liquid or solid material that is evolved from the target site. For example, the desorbed analyte can be in a gaseous form, an aerosol form or even a particulate form.

The laser source 20 can be any appropriate gas or solid state laser emitting a laser beam of sufficient intensity and wavelength to evolve a desorbed analyte 28 from the target site 26. The laser beam 22 can propagate through the atmosphere or through an optical coupler 30, e.g., lenses or fiber optic wires. The optical coupler 30 can be positioned between the laser source 20 and the specimen stage 12. The wavelength of the laser source 20 can be selected in order to facilitate energy absorption by the target site 26.

As clearly seen in FIG. 6, a free surface 32 of the suspended solvent 18 can have the form of a meniscus. As the desorbed analyte 28 contacts the free surface 32, the analyte can mix with, e.g., dissolve in, the solvent 18 to form a testing solution 34. Although a liquid micro-junction can be formed during the desorption step, as shown in FIG. 2, the distance (h) between the free surface 32 and the specimen (S) can be a positive value, i.e., no liquid micro-junction. The distance (h) between the free surface 32 and the specimen can be between 1 μm and 3 mm, or between 50 μm and 2 mm or between 100 μm and 1 mm. The distance can be 1 mm or less, or 750 μm or less, or 500 μm or less, or 250 μm or less, or 150 μm or less.

As shown in FIGS. 2 & 6, the sampling probe 16 can include an outer capillary tube 66 and an inner capillary tube 68 disposed co-axially within the outer capillary tube 66. The inner and outer capillary tubes 68, 66 can define a solvent capillary 70 and a sampling capillary 72 in fluid communication with one another at a distal end of the probe 16. As shown in FIGS. 2 & 6, the tip of the inner capillary tube 68 can be recessed within the outer capillary tube 66. Although FIGS. 2 & 6 show the solvent capillary 70 defined by the inner capillary tube and the sampling capillary 72 defined by the annular space between the inner and outer capillary tubes 68, 66, it should be understood that this flow arrangement can be reversed.

Figure 7:
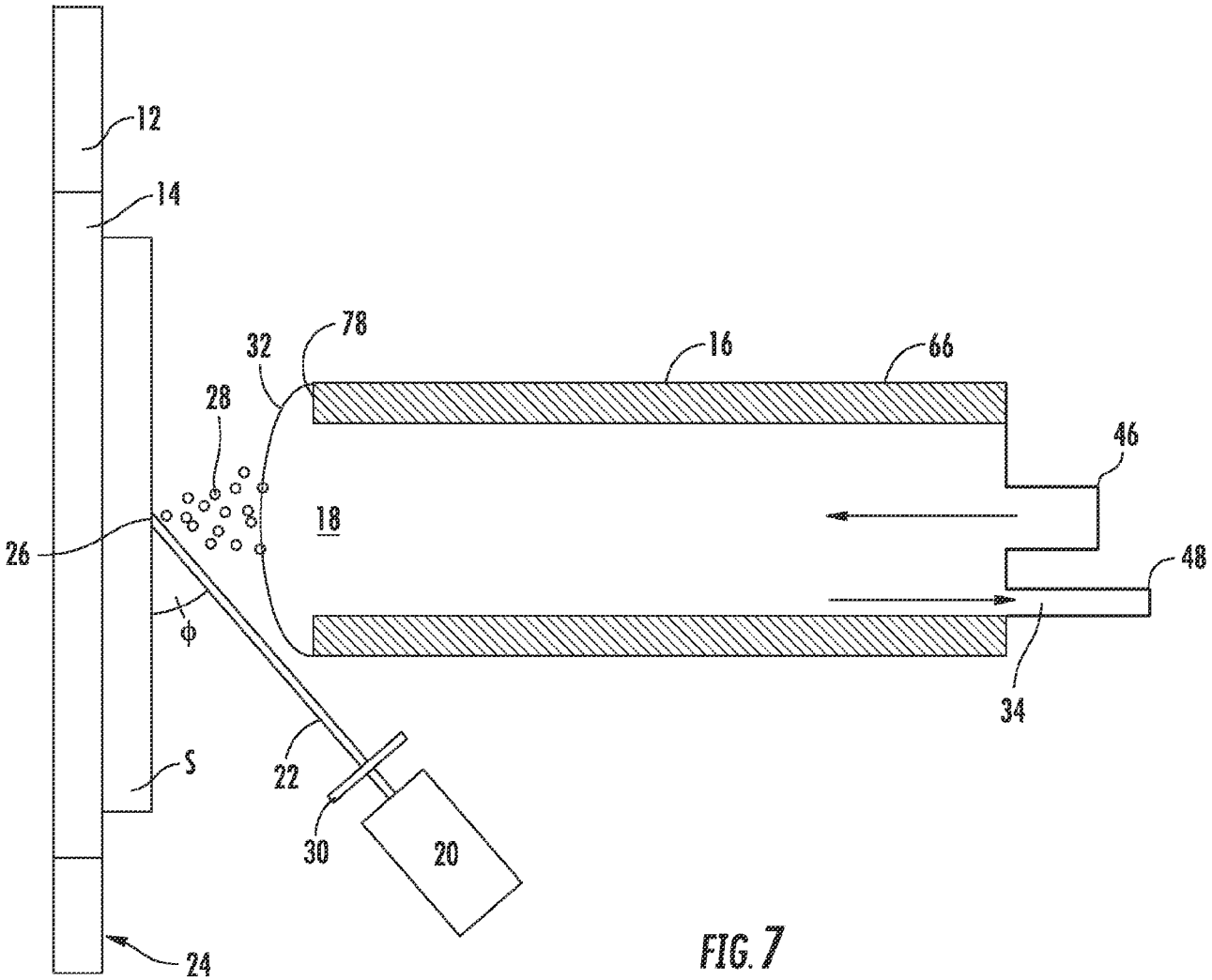
FIG. 7 is a cross-sectional view of the laser desorption system of FIG. 5 taken along cut line C-C', where the sampling probe has a single capillary configuration.

As shown in FIGS. 3 & 7, the sampling probe 16 can include a single capillary 66 with a solvent inlet 46 and a sampling outlet 48. In the single capillary embodiment, the sampling probe 16 does not include an inner capillary tube in fluid communication with the single outer capillary 66. In an alternate example, the solvent inlet 46 and sampling outlet 48 are essentially combined and both functionalities are provided through a single coupling 46, 48. For example, the example shown in FIGS. 8A-F would only require one coupling that could be used to draw in a solvent 18 through the tip 78 of the probe 16 and then dispense the testing solution 34 through the same tip 78.

The system 10 can also include an analytical instrument 36 for determining a chemical composition of an analyte at a target site 26 on a specimen (S) being analyzed via the testing solution 34. The solvent 18 can be in fluidic communication with a solvent pump 44 via a solvent inlet 46. The solvent 18 can be in fluid communication with the analytical instrument 36 via a sampling outlet 48. The solvent 18 and/or testing solution 34 can be in fluid communication with the analytical instrument 36.

A sampling pump 50 can be provided in order to control the output rate from the sampling outlet 48. This enables the user to control the flow rates at the sampling outlet 48 and the solvent inlet 46, which can be the same or different flow rates. Although shown separately, the sampling pump 50 can be incorporated into the probe 16 or any downstream device, such as an analytical instrument 36. The pumps 44, 50 can be any form of pump including, but not limited to velocity pumps, buoyancy pumps, syringe pumps, positive displacement pumps, venturi pumps, and gravity pumps. Of particular interest, the pumps 44, 50 can be syringe pumps, positive displacement pumps, nebulization or electrospraying devices, or chambers with sufficient pressure differentials to induce fluid flow.

Figure 5:
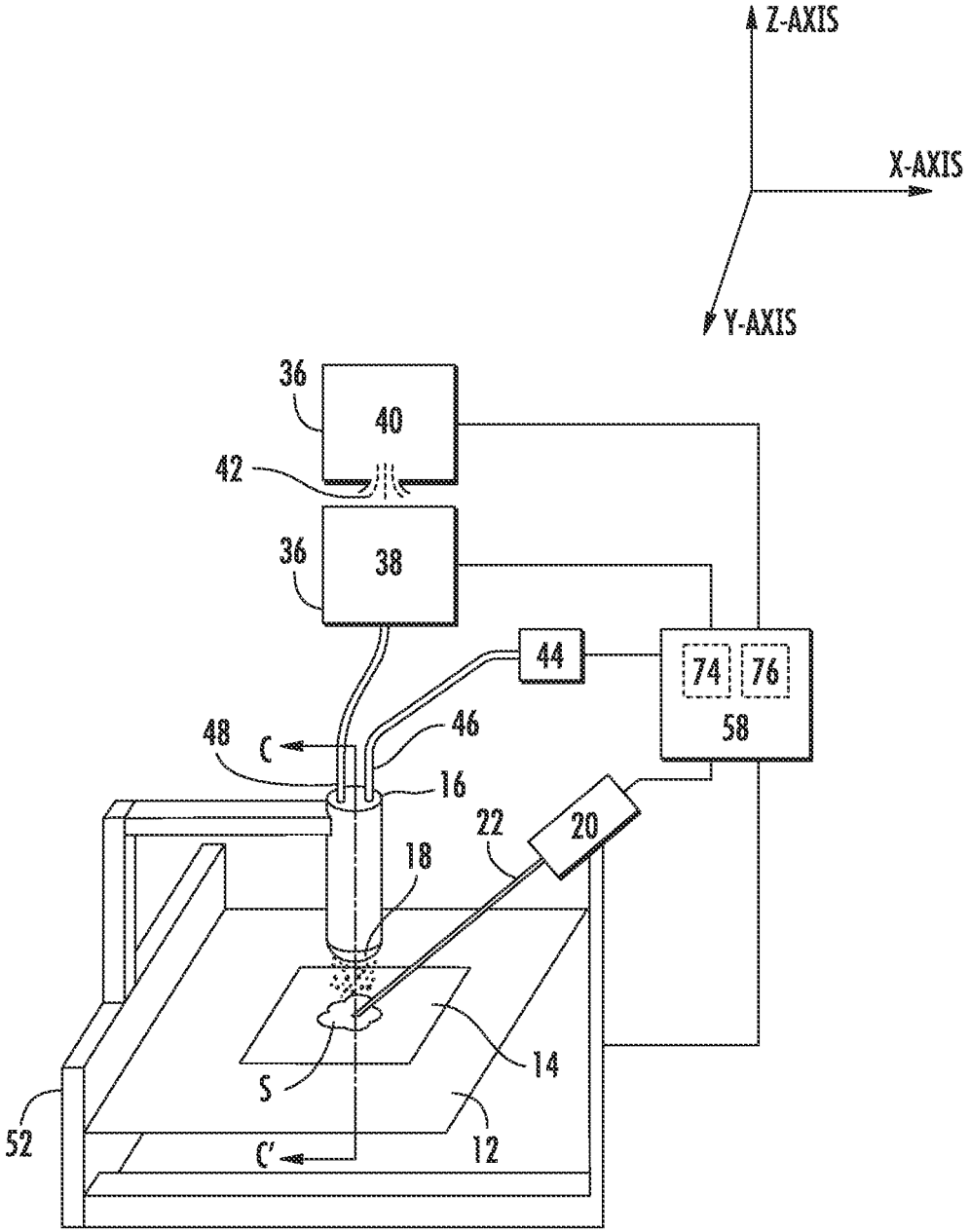
FIG. 5 is a schematic of a reflective geometry laser desorption system according to the invention.

The analytical instrument 36 can be a mass spectrometer, an ionization source, a separation method, or a combination thereof. As shown in FIGS. 1 & 5, the analytical instrument 36 can be an ionization source 38 and a mass spectrometer 40. The mass spectrometer 40 can be arranged to receive an ionized analyte 42 from the ionization source 38.

The analytical instrument 36 can be any instrument utilized for analyzing analyte solutions. Exemplary analytical instruments include, but are not limited to, mass spectrometers, ionization sources, spectroscopy devices, separation methods, and combinations thereof. Exemplary ionization sources include, but are not limited to electrospray ionization, atmospheric pressure chemical ionization, electrospray chemical ionization (ESCi), atmospheric pressure photo-ionization or inductively coupled plasma. Exemplary separation methods include, but are not limited to liquid chromatography, solid phase extraction, HPLC, capillary electrophoresis, or any other liquid phase sample cleanup or separation process. Exemplary mass spectrometers ("MS") include, but are not limited to, sector MS, time-of-flight MS, quadrupole mass filter MS, three-dimensional quadrupole ion trap MS, linear quadrupole ion trap MS, Fourier transform ion cyclotron resonance MS, orbitrap MS and toroidal ion trap MS.

The system can include a stepper mechanism 52 configured to sequentially direct the laser beam 22 at a plurality of target sites 26 of a specimen (S) supported by the specimen stage 12. The stepper mechanism 52 can also be configured to provide relative motion between the specimen stage 12 and the sampling probe 16.

As used herein, a stepper mechanism has its standard meaning in the art and should be understood to include any device or combination of devices for changing the relative position between the sampling probe 16, the specimen stage 12 or the specimen (S) supported thereon, and/or the laser source 20. For example, the specimen stage 12 can be coupled to the stepper mechanism 52 and move the sample stage 12 laterally (X-axis), transversely (Y-axis), and vertically (Z-axis) along a sampling path 54. Alternately, the probe 16 can be coupled to the stepper 52, which can move the probe 16 laterally, transversely and vertically along the sampling path 54. Finally, the laser source 20 can be coupled to the stepper 52, which can direct the laser beam 22 along the sampling path 54 by rotating the laser source 20 and moving the laser source 20 laterally, transversely and vertically.

Figure 4:
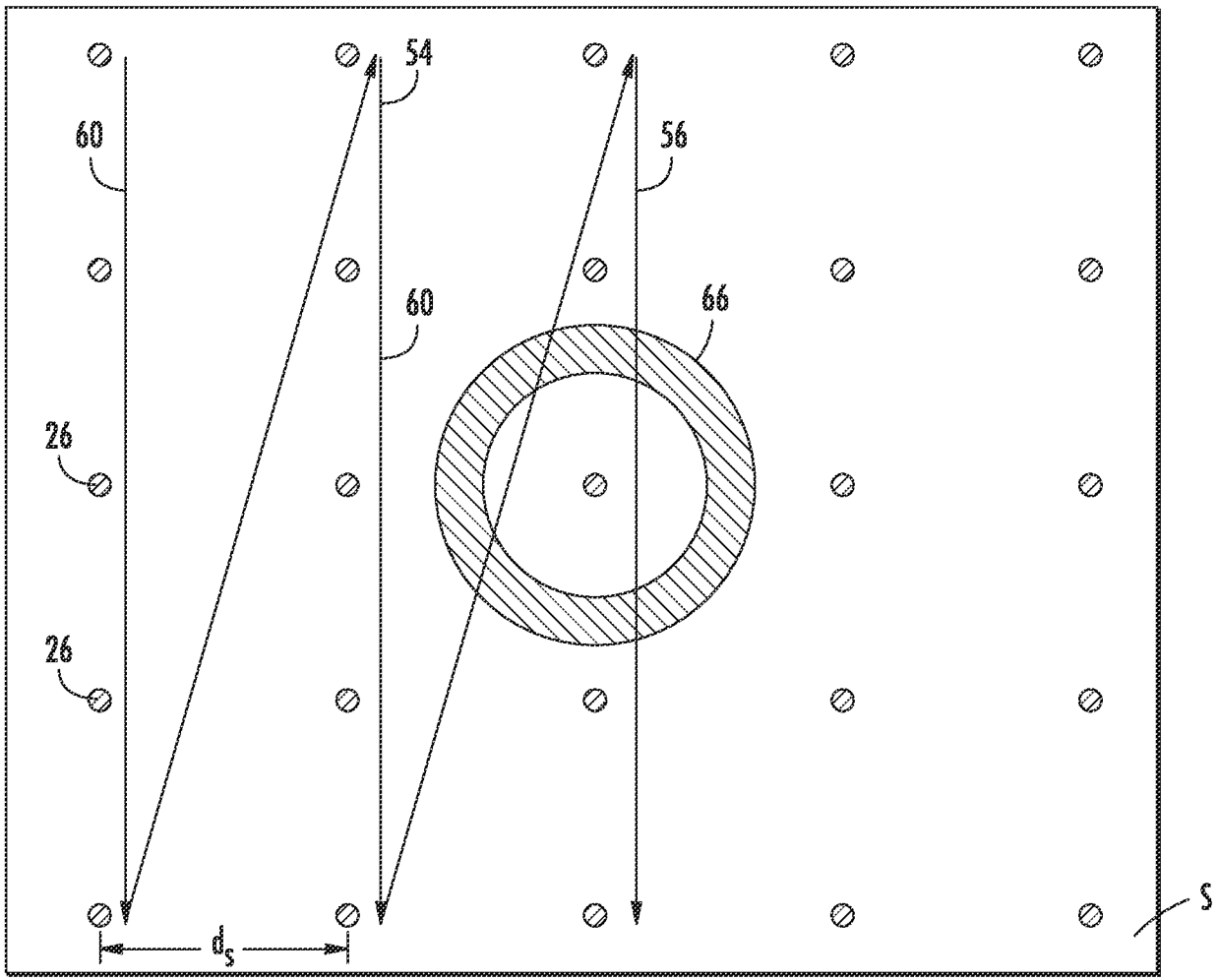
FIG. 4 is a cross-sectional view of the laser desorption system of FIG. 2 taken along cut line B-B', including a depiction of the sampling path.

As shown in FIG. 4, a sampling path 54 can be a sampling regime that includes a plurality of target sites 26. FIG. 4 only shows the lateral and transverse components of the sequence for sampling the target sites 26 along the sampling path 54; however, the sampling path 54 can also include a vertical component. For example, as shown in FIGS. 8A-F, the probe 16 can be positioned proximate a first target site 26 in order to capture the desorbed analyte 28 and can then be repositioned proximate an electrospray ionization (ESI) chip 56 so that the testing solution 34 can be dispensed through the ESI chip 56.

The articulation by the stepper 52 between sequential target sites 26 can occur with the laser beam 22 on or with the laser beam 22 off. Thus, turning the laser beam 22 off during articulation between target sites 26 allows sampling along a sampling path 54 that includes discrete target sites 26 as shown in FIG. 4. Whereas, maintaining the laser beam 22 during articulation between target sites 26 allows sampling of linear target sites 60, i.e., target lines, as also shown in FIG. 4. The controller 58 can be configured for causing the stepper mechanism 42 to perform each of the sampling sequences described anywhere herein.

In some examples, the target sites 26 can be sampling lines 60. In general, the plurality of sampling lines 60 will be parallel and spaced apart by a distance ($d_s$). In such an embodiment, the specimen (S) can be laser desorbed, i.e., sampled, along an entire sampling line 60. The laser beam 22 can be turned off and repositioned to travel along the next sampling line 60.

The sampling path 54 can be an array of regularly spaced target sites 26. As used herein, "regular spacing" and "regularly spaced" are used interchangeably and refer to spacing where the distance between adjacent target sites 26 in a line is equal or approximately equal along the length of the line, as shown in FIG. 4. Regular spacing also refers to instances where the same target site is part of two or more lines with regular spacing, which is also shown in FIG. 4. Of interest, the distance between adjacent target sites 26 or adjacent sampling lines 60 can be 100 μm or less, or 50 μm or less, or 25 μm or less, or 10 μm or less, or 5 μm or less.

As shown in FIGS. 8A-F, the stepper mechanism 52 can also be configured (i) to sequentially position the sampling probe 16 to capture a desorbed analyte 28 that is laser desorbed from each of a plurality of target sites 26 with a suspended solvent 18 to form a testing solution 34 and (ii) to discharge the testing solution 34 to a testing device 62. As used herein, the phrase "testing device" includes not only analytical instruments 36, but also devices useful for intermediate processing steps. For example, the testing device 62 could be a plate with a plurality of wells that allows the analyte in the testing solution 34 to react or culture. Exemplary testing devices, other than analytical instruments, include UV visible spectrometer, fluorometer, pH measuring devices, conductivity measuring devices, etc. It is to be understood that all analytical instruments 36 are testing devices 62.

Figure 8A:
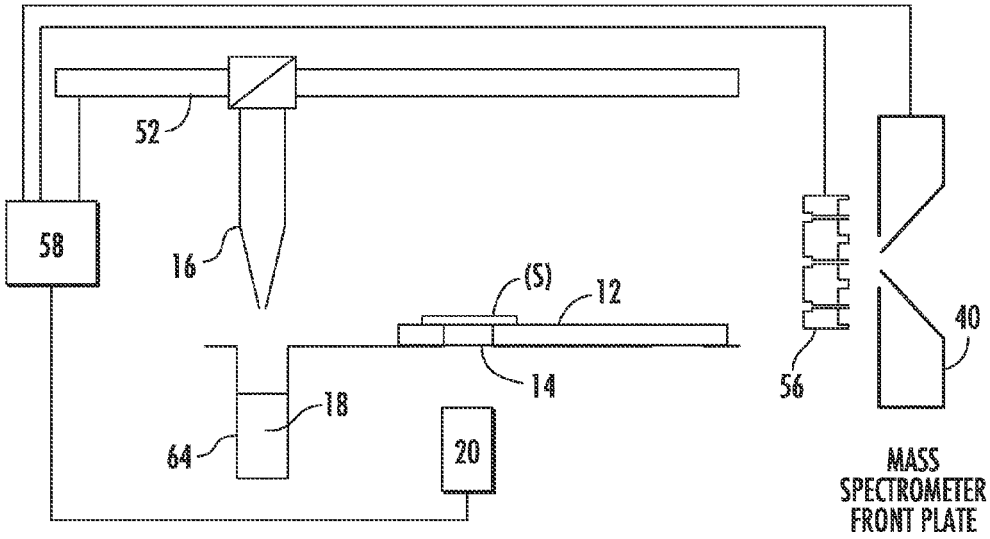
FIGS. 8A-F show a sampling sequence of a laser desorption system according to the invention where the testing solution is dispensed from the tip of the sampling probe.
Figure 8B:
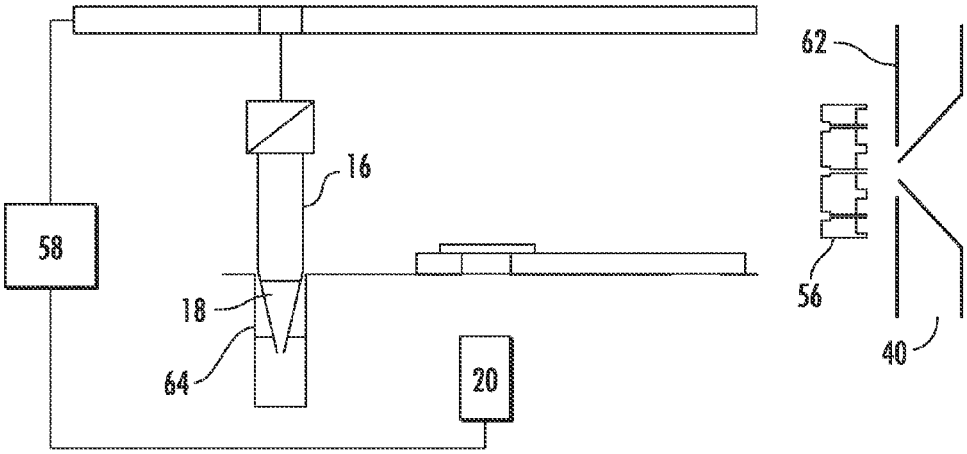
Figure 8C:
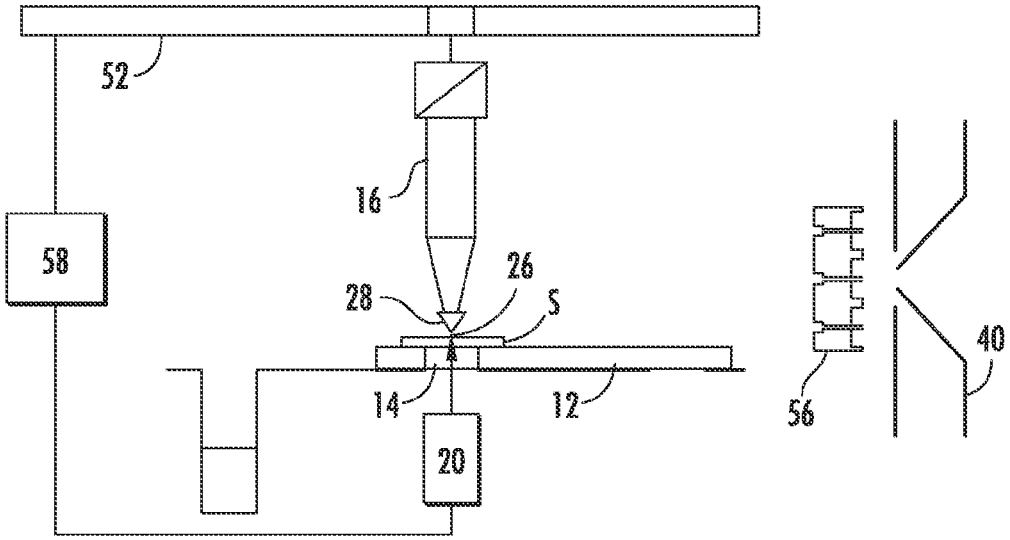
Figure 8D:
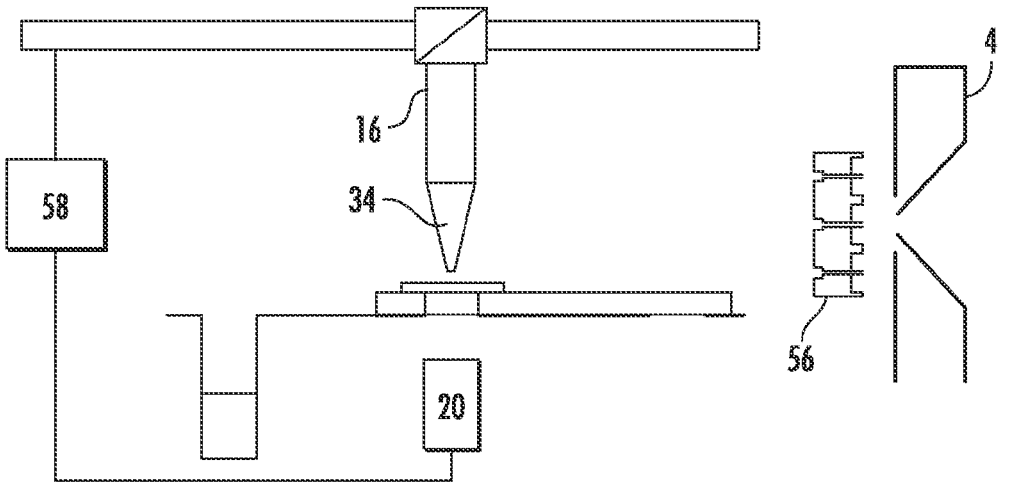
Figure 8E:
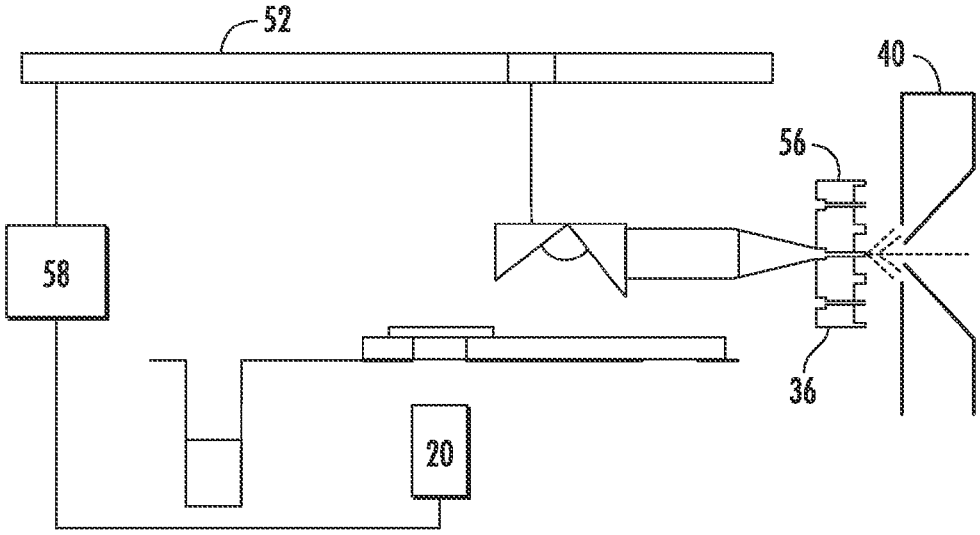
Figure 8F:
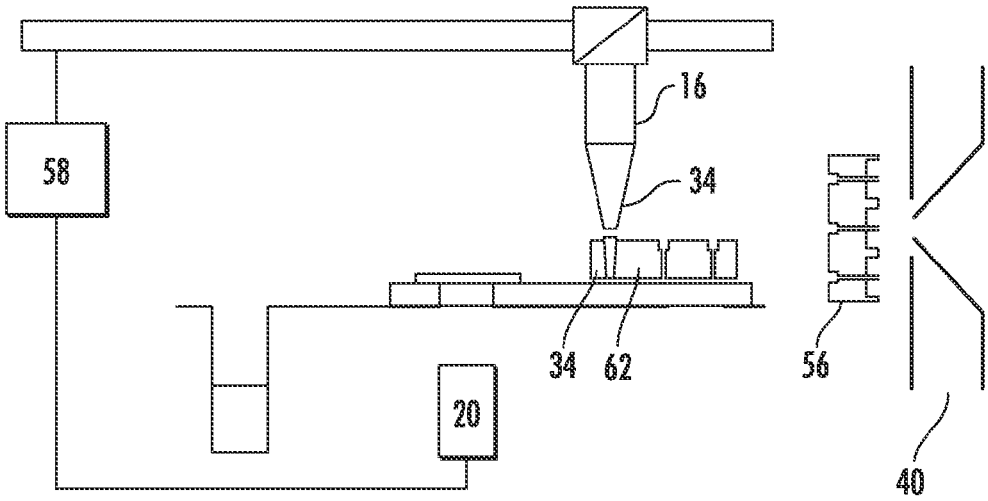

As shown in FIGS. 8A-F, the testing solution 34 can be discharged from a distal end of the sampling probe 16. As shown in FIG. 8A, an empty sampling probe 16 can be suspended over a solvent reservoir 64 by the stepper mechanism 52. The stepper mechanism 52 can then lower the sampling probe 16 into the solvent reservoir 64 and solvent 18 can be drawn into the sampling probe 16, as shown in FIG. 8B. The sampling probe 16 can then be positioned above the target site 26 and the laser source 20 actuated to direct a laser beam 22 at the target site 26, as shown in FIG. 8C. The laser beam 22 can cause the formation of a desorbed analyte 28. As shown in FIG. 8D, the desorbed analyte 28 can contact and mix with the solvent 18 to form a testing solution 34. The testing solution 34 can then be dispensed into a testing device 62 such as an ESI ionization chip 56 and mass spectrometer 40 or into a testing device 62, such as a well plate, as shown in FIGS. 8E and 8F, respectively.

As shown in FIG. 8E, the sampling probe 16 can be repositioned proximate to an analytical instrument 36 and the testing solution 34 can be dispensed into the analytical instrument 36. Alternately, the sampling probe 16 can be repositioned proximate to a well plate 62 and some or all of the testing solution 34 can be dispensed into one or more wells of the well plate 62, as shown in FIG. 8F. In the embodiment of FIG. 8F, the testing solution 34 can undergo further processing, incubating and analyzing steps after being dispensed into the well plate 62. The process can be repeated for each of a plurality of target sites 26. The tip of the probe 16, e.g., a pipette tip, can be replaced for each target site 26.

The data from each of the target sites 26 can be stored on a computer readable storage, such as are known in the art. The data can be compiled to form a two-dimensional map, or surface, of the composition of the specimen by plotting the data according to the position of the array of target sites from which the data was obtained. The data can be displayed on an output device, such as a monitor, printer, smartphone or the like.

The system 10 can include a controller 58 communicatively coupled to one or more of the laser source 20, the stepper mechanism 52, the solvent pump 44, the sampling pump 50 and any analytical instruments 36. The controller 58 can also be configured for causing the system 10 components described herein to carry out any of the method steps or processes described herein. For example, the controller 58 can be configured to cause the stepper mechanism 42 to produce any relative motion between the laser source 20, the specimen stage 12, including the desorption region 14, and the sampling probe 16, described herein.

The controller 58 can include a computer readable storage 74 in communication with a processor 76. The computer readable storage 74 can include computer executable instructions for carrying out the methods described herein. The processor 76 can be configured to execute the computer executable instructions stored on the computer readable storage 74. In addition, although shown as a single box that includes a single computer readable storage 74 and a single processor 76, it should be understood that the controller 58 can be spread across multiple devices and can include multiple computer readable storages and processors.

As used herein, sequentially articulate refers to automatically moving the probe 12, the sample stage 40, or both along the sampling path 52 to a plurality of target sites 44. In some instances this articulation can be continuous while in others there will be intermittent pauses. For example, the articulation may be paused while the desorbed analyte 28 contacts the free surface 32 of the solvent 18 in order to ensure an adequate amount of analyte is present in the testing solution 34 or to provide adequate separation between ionized analyte 42 samples being fed to an analytical instrument 36, such as a mass spectrometer 40.

The system 10 can also include a specimen stage 12, a sampling probe 16 configured to suspend a solvent 18 in the form of an uninterrupted meniscus 32 above the specimen stage 12, a laser source 20, and a stepper mechanism 58 configured to provide relative motion between the laser source 20 and the specimen stage 12. As shown in FIGS. 5-7, the laser source 22 and the sampling probe 16 can both be on a primary surface-side 24 of the specimen stage 12.

In instances where the laser source 20 and the sampling probe 16 are on the primary surface-side 24 of the specimen stage 12, the incident angle (θ) of the laser beam 22 can be between 0 and 90°, or between 30 and 80°, or between 35 and 70°. The sampling probe 16 can have a dual capillary arrangement or single capillary arrangement, as shown in FIGS. 6 & 7, respectively.

As used herein, the phrase "uninterrupted meniscus" refers to a continuous meniscus that is not interrupted by a part of the probe 16. For example, as shown in FIGS. 6 & 7, the meniscus 32 extends from the tip 78 of the outer capillary tube 66 and is not interrupted by the interior capillary tube 68. In addition, the flow regime and flow rates shown in FIGS. 6 & 7 are such that the flow of the testing solution 34 exiting the probe 16 does not disrupt the shape of the meniscus 32.

The invention is also drawn to a method of extracting an analyte from a specimen (S). The method can include providing a specimen (S) supported by a desorption region 14 of a specimen stage 12; desorbing an analyte from a target site 26 of the sample (S) with a laser beam 22 centered at a radiation wavelength (λ); and capturing the desorbed analyte 28 with a suspended solvent 18 to form a testing solution 34. The desorption region 14 can be transparent to the radiation wavelength (λ). The specimen (S) and the laser source 20 emitting the laser beam 22 can be on opposite sides of a primary surface 24 of the specimen stage 12. The method can also include analyzing a chemical composition of the desorbed analyte 28.

The desorbing, capturing and analyzing steps can be repeated for each of a plurality of target sites 26 of the specimen (S), e.g., each target site 26 along the sampling path 54. A chemical property of the analyte collected from each target site 26 can be plotted. The relevant chemical property can be any exogenous or endogenous property related to the specimen (S) being evaluated, including a property of a molecule or chemical component for each of the target sites 26. Properties of interest include, but are not limited to, concentration of a molecule or decomposition product, the relative ratio of two molecules (such as compound and reaction product of the compound), and the relative ratio of decomposition products.

For example, the property of interest can be the concentration of a chemical component, such as a pharmaceutical and its metabolites, at each target site 26. By arranging the data for each target site spatially within the specimen (S) a two-dimensional surface can be plotted.

In another example, the method can include desorbing an analyte from a target site 26 of a specimen (S) with a laser beam 22 centered at a radiation wavelength (λ); capturing the desorbed analyte 28 with a solvent 18 suspended in the form of an uninterrupted meniscus 32 above the specimen (S) to form a testing solution 34; and dispensing the testing solution 34 to a testing device 62. The sample (S), the laser beam 22 or both can be automatically, sequentially articulating to sample a second target site 26 and the desorbing, capturing and dispensing steps can be repeated for the second target site 26 of the specimen (S).

The laser source 20 and the sampling probe 16 can both be on the primary surface-side 24 of the specimen stage 12. Alternately, the laser source 20 and the sampling probe 16 can be on opposite sides of the specimen stage 12.

EXAMPLES

Example 1

Reflective Geometry, Dual Capillary Sampling Probe

The reflective geometry data was gathered using an arrangement similar to that shown in FIG. 6. In the probe used in the examples, the outer diameter and inner diameter of the outer capillary were ~635 μm and ~330 μm, respectively, while the outer diameter and inner diameter of the inner capillary were ~254 μm and ~127 μm, respectively.

The laser beam was propagated through a 400 μm fiber optic cable and then passed through a 35 mm focusing lens onto the target site. The impingement angle (θ) was 45°, the laser beam wavelength was 337 nm and the fluence of the beam was 80 mJ/cm$^2$. The solvent utilized was a 50:50 mixture of acetonitrile and water and the solvent flow rate was 13 μL/min.

Figure 9:
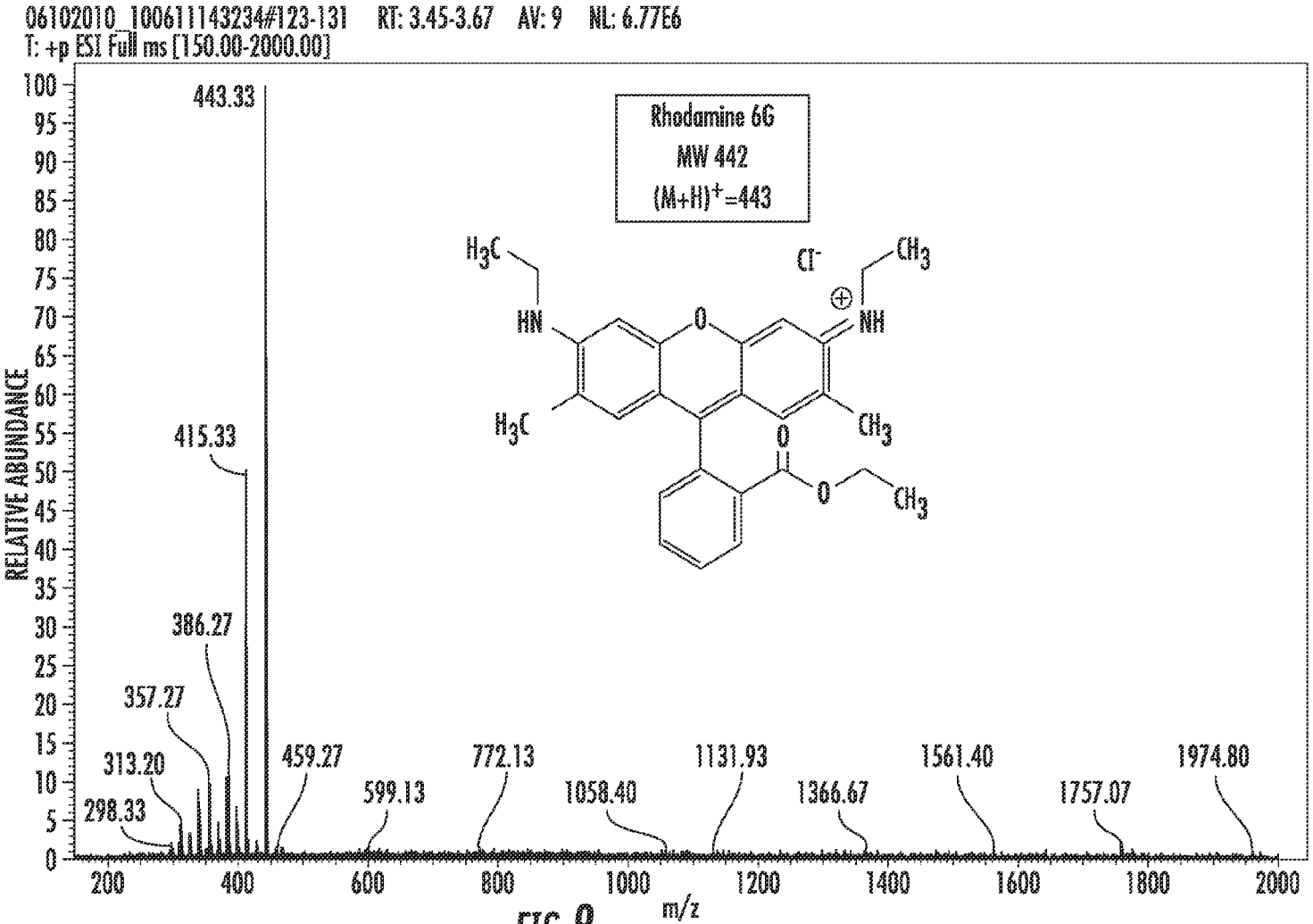
FIG. 9 shows relative abundance versus m/z for a rhodamine 6G ($M_w$=442) sampling analyzed using a reflective geometry laser desorption system according to the invention.

FIG. 9 shows the mass spectrometer abundance versus m/z data where the specimen was Rhodamine 6G, which has a molecular weight of 442 g/mol, on a glass slide. The data clearly shows the protonated form of Rhodamine 6G at m/z=443 as the base peak in the mass spectrum. These results correspond well with known data for Rhodamine 6G.

Figure 10:
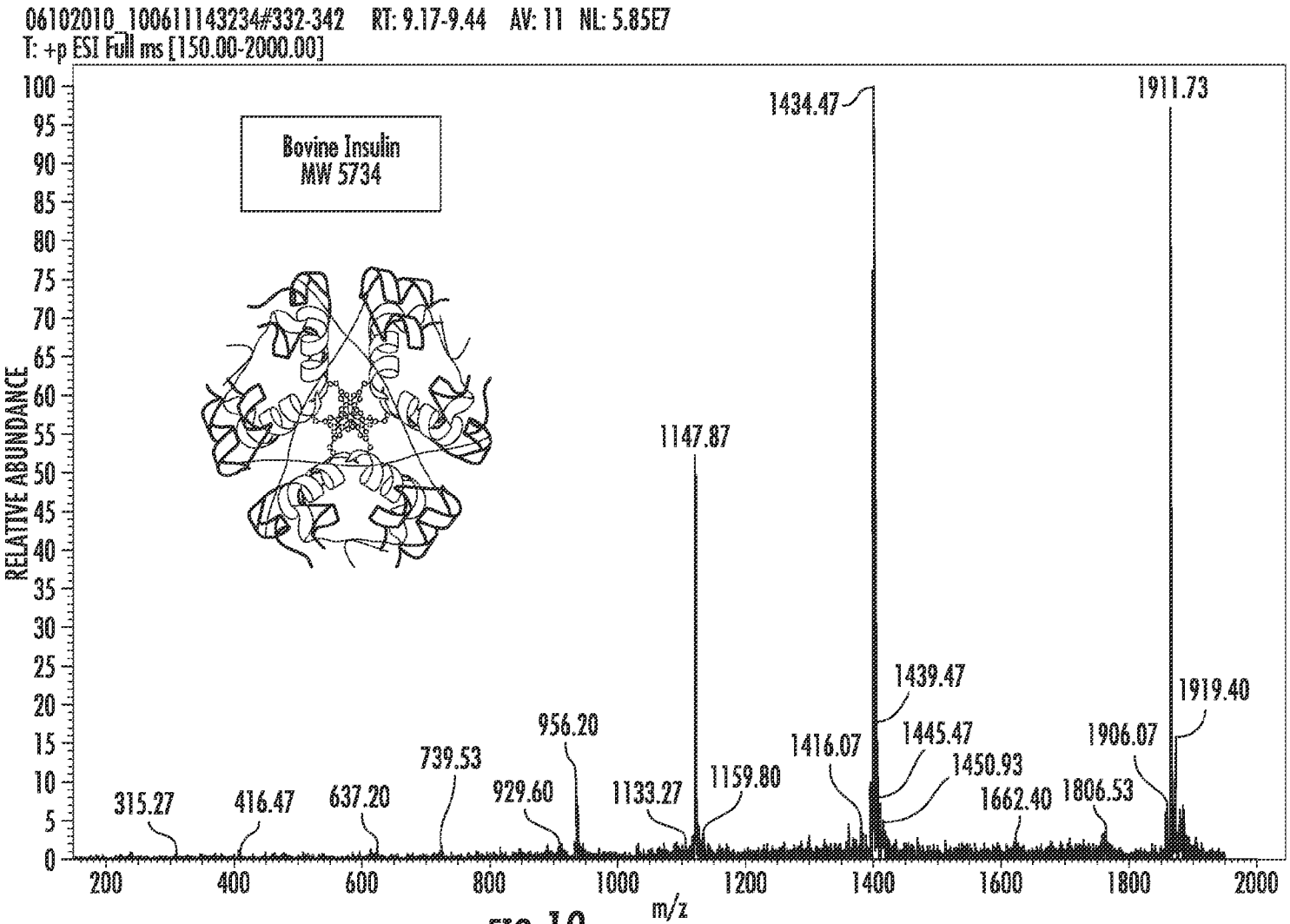
FIG. 10 shows relative abundance versus m/z for a bovine insulin ($M_w$=5734) sampling analyzed using a reflective geometry laser desorption system according to the invention.
Figure 17:
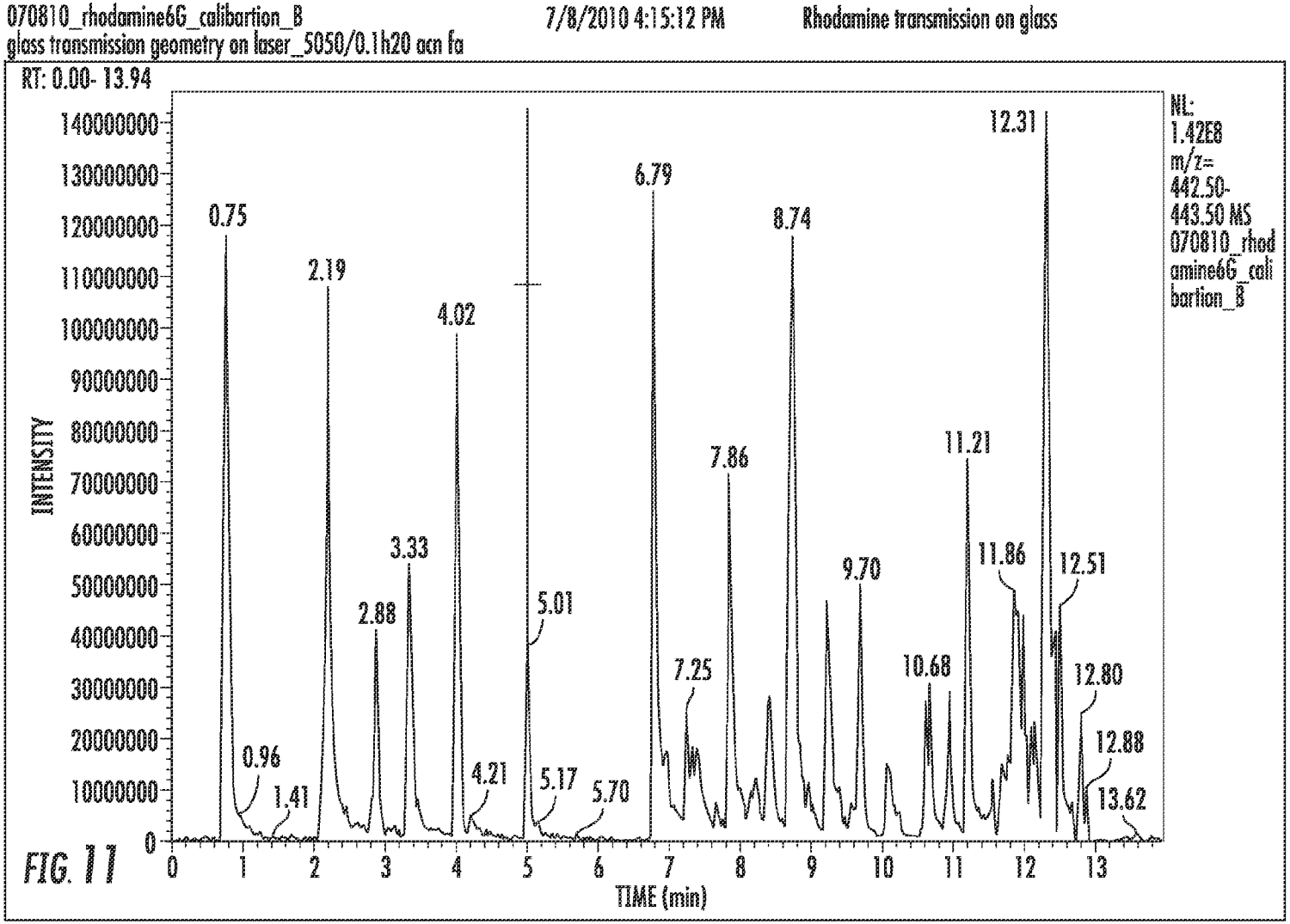

FIG. 10 shows the mass spectrometer relative abundance versus m/z data where the specimen was 340 pmol of bovine insulin with a molecular weight of 5734 g/mol on a glass slide. The relevant peaks include m/z=956, m/z=1147, m/z=1434, and m/z=1911, which correspond to the +6, +5, +4 and +3 charge states of bovine insulin, respectively. This result is consistent with known charge states for the electrospray spectrum of bovine insulin. This is of particular interest because conventional laser desorption techniques, such as MALDI, typically exhibit only the +1 charge state. The data shows that the disclosed method and system are capable of desorbing and capturing analytes with a wide range of molecular weights and multiple charging of molecules, such as proteins.

Example 2

Transmission Geometry, Dual Capillary Sampling Probe

The transmission geometry data was gathered using an arrangement similar to that shown in FIG. 2. The laser beam was propagated through a 400 μm fiber optic cable and then passed through a 35 mm focusing lens toward the target site. The impingement angle (ϕ) was 90°, the laser beam wavelength was 337 nm and the fluence of the beam was 80 ml/cm$^2$. The probe tip was positioned 0.5 mm from the sample and the solvent utilized was a 50:50 mixture of acetonitrile and water. The specimen stage included a desorption region made of quartz and the energy transmitted through the quartz was 100 μJ.

Figure 12:
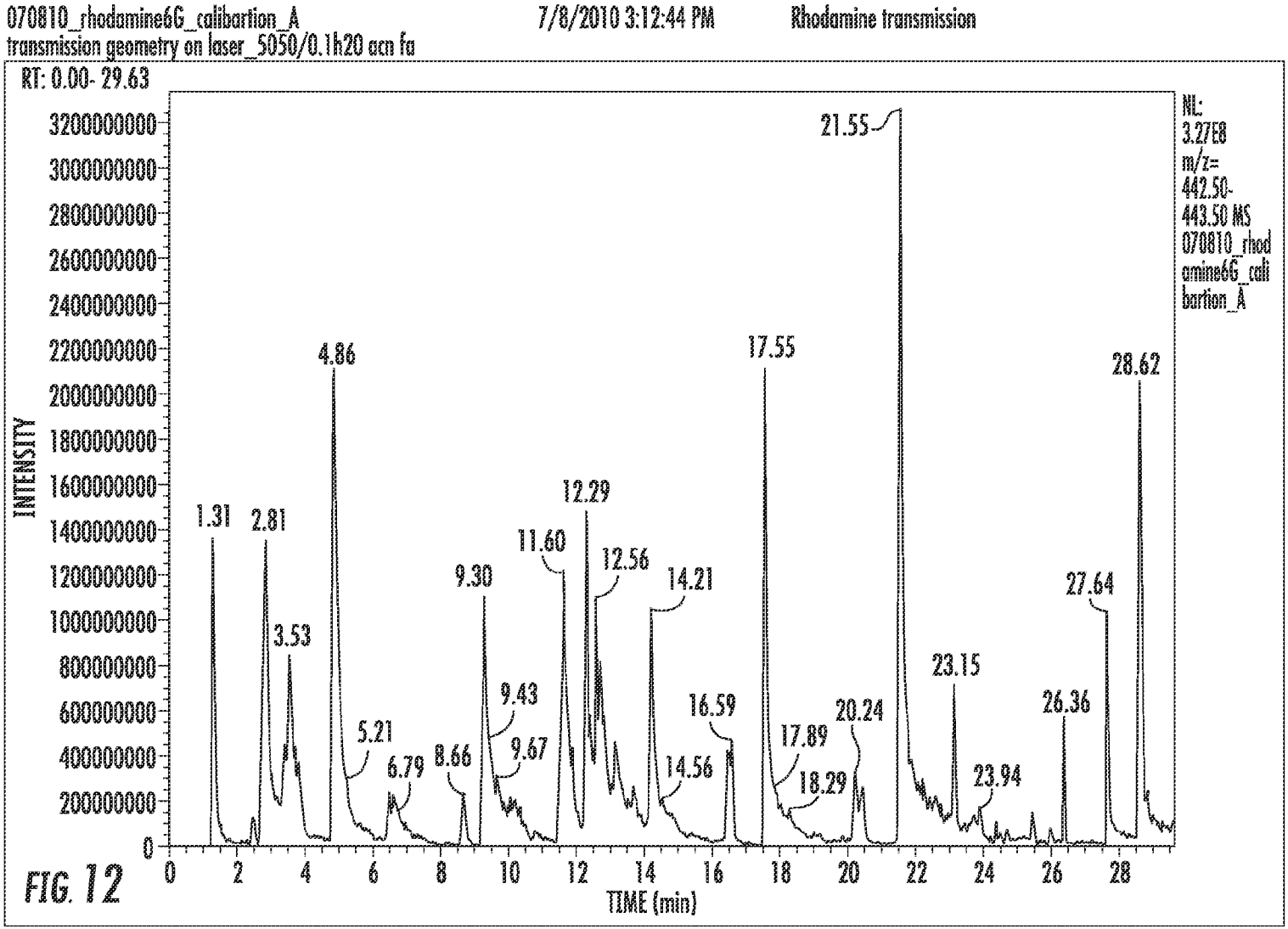
FIG. 12 shows intensity versus time data for a rhodamine 6G sample on quartz obtained using a transmission geometry laser desorption system according to the invention.

FIGS. 11 & 12 shows the mass spectrometer intensity versus time data for a rhodamine 6G sample on a glass slide and a quartz slide, respectively. The rhodamine 6G signal level on glass was approximately $1.4\times1^{08}$, while the signal level on quartz was approximately $3.2\times1^{08}$. In contrast, the signal intensity for rhodamine 6G on a glass slide using the reflective geometry was $1\times1^{07}$, or an order of magnitude less than using the transmission geometry. Thus, the transmission geometry is superior to the reflective geometry. This is particularly true where desorption region and specimen slide are formed from quartz.

Example 3

Transmission Geometry, Single Capillary Sampling Probe

Sampling

This transmission geometry data was gathered using an arrangement similar to that shown in FIG. 3. The laser beam and focusing lens system was the same as that used in Example 2. The sampling probe was a 10 μL syringe loaded with 3 μL of solvent. The solvent composition was 49.95/49.95/0.1 water/acetonitrile/formic acid. The tip of the syringe was positioned 0.5 mm above the sample surface.

The laser was fired and 1 μL of solvent was dispensed from the syringe at a rate of 16 nL/sec, i.e., desorption step of approximately 1 minute. After the desorption step, the droplet hanging from the syringe tip was drawn into the syringe at a rate of 0.1 μL/sec for two (2) seconds. The testing solution in the syringe was then dispensed into an analytical instrument at a rate of 1 μL/s.

Mass Spectrometer Results

Figure 13A:
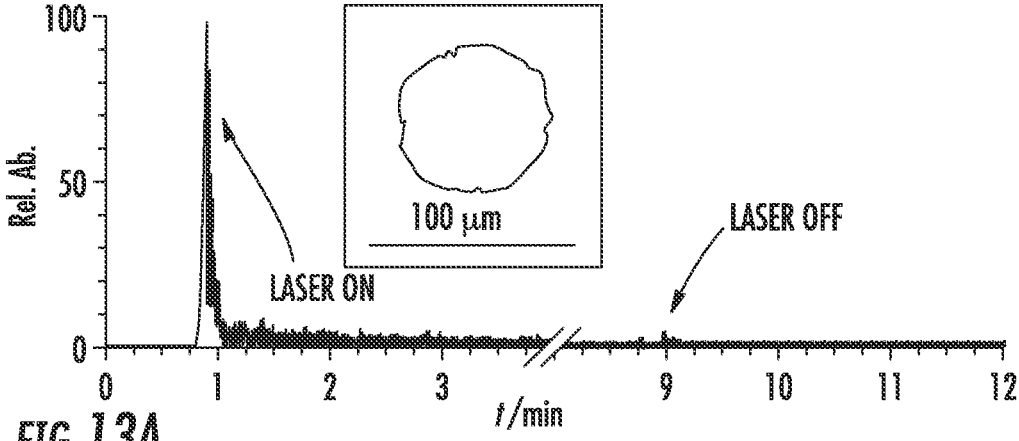
FIGS. 13A-C show (a) relative abundance versus time data for a rhodamine 6G sample on glass using a transmission geometry with a single capillary sampling device, (b) relative abundance versus m/z data for a testing solution collected using the laser desorption described herein, and (c) relative abundance versus m/z data for a control testing solution where a laser beam was not applied to the specimen.
Figure 13B:
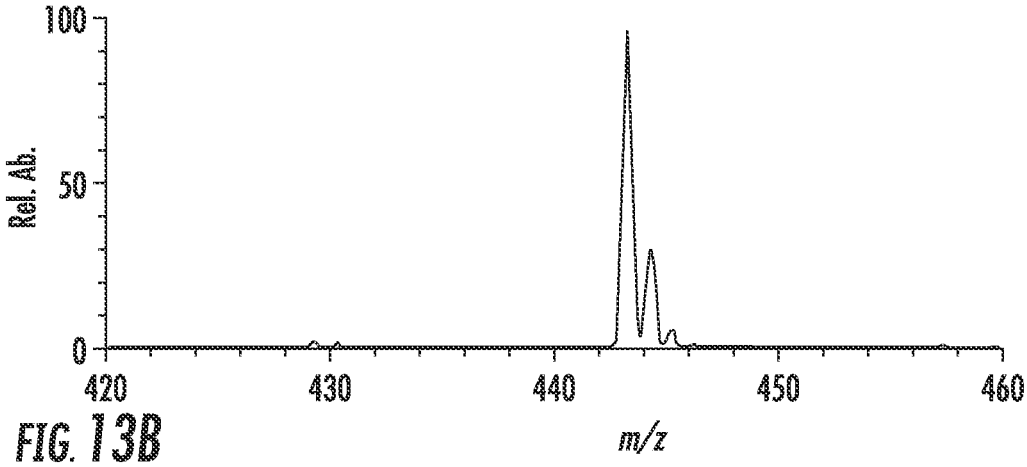
Figure 13C:
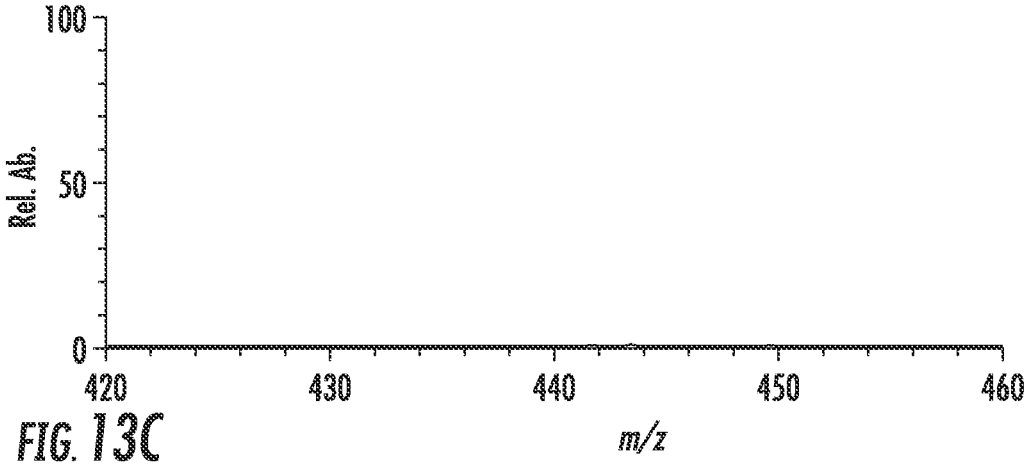

In the first part of this Example, testing solutions were collected both with and without the laser beam. The target analyte in both cases was rhodamine 6G and the testing solutions were injected into an electrospray ionization source that was operatively coupled to a mass spectrometer. FIG. 13(*a*) shows the extracted ion chromatogram generated using the ion intensity for m/z=443. At the far left is the peak resulting when a testing solution collected with the laser beam on (Sample A) was injected into the ESI source, while the point at 9 minutes shows there was no peak when a testing solution collected without the laser beam (Sample B) was injected into the ESI source. The inset of FIG. 13(*a*) shows an approximately 70 μm-diameter ablated area resulting from the laser desorption. FIGS. 13(*b*) and (*c*) show the relative abundance versus m/z data for Sample A and Sample B, respectively.

HPLC+Mass Spectrometer Data

Figure 14:
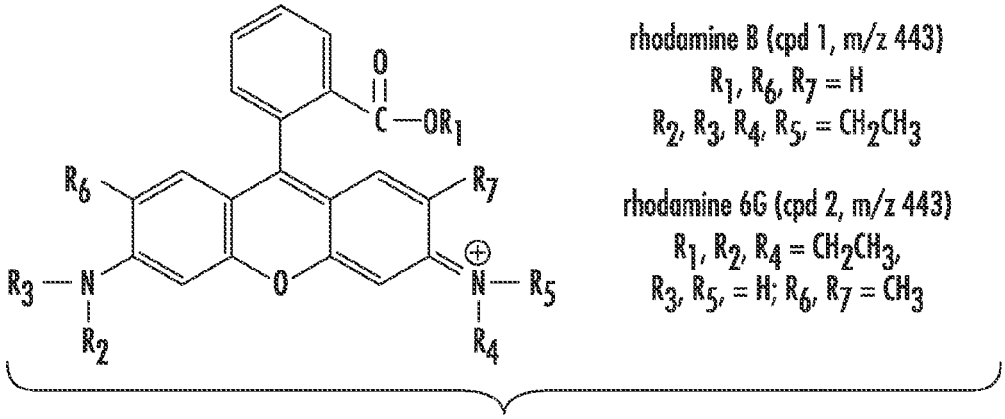
FIG. 14 shows the chemical structures of rhodamine B and rhodamine 6G.

In the second part of this Example, the target analyte included a 50:50 mass ratio of Rhodamine B and Rhodamine 6G, the chemical structures of which are shown in FIG. 14. The testing solution was collected as described in this Example and then injected into an HPLC device that was directly linked to an electrospray ionization source that was directly linked to a mass spectrometer. The HPLC was a Waters PAH C18 5 μm with a 2×150 mm column. The HPLC program was isocratic and the flow rate of the carrier gas was set to 200 μL/min.

Following desorption, a 70 μm diameter ablated area was observed. Based on a 1 mm diameter circular target site formed using a 10 μL Rhodamine B/6G sample, this means that the amount of desorbed analyte was approximately 10.88 ng or 24.6 pmol.

Figure 15A:
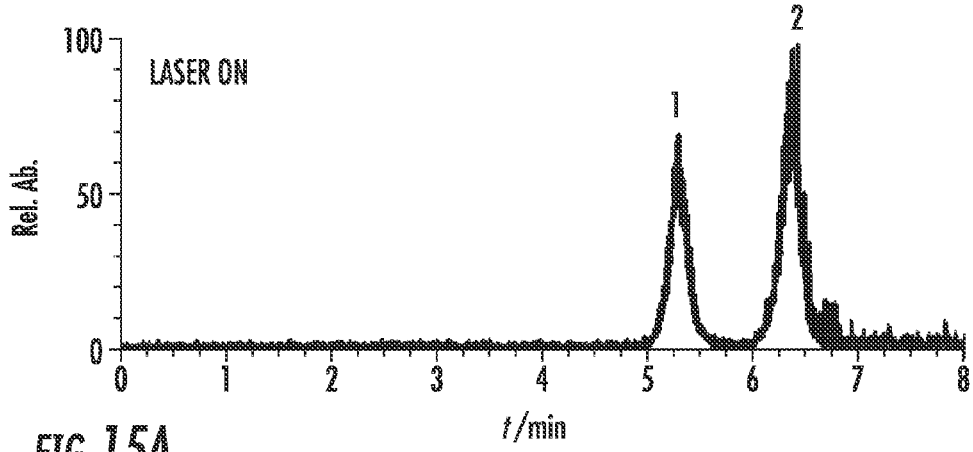
FIGS. 15A & B show (a) relative abundance versus time data for a testing solution containing both rhodamine B (1) and rhodamine 6G (2) that were laser desorbed and separated by HPLC, and (b) relative abundance versus time data for a testing solution where a laser beam was not applied to the specimen.
Figure 15B:
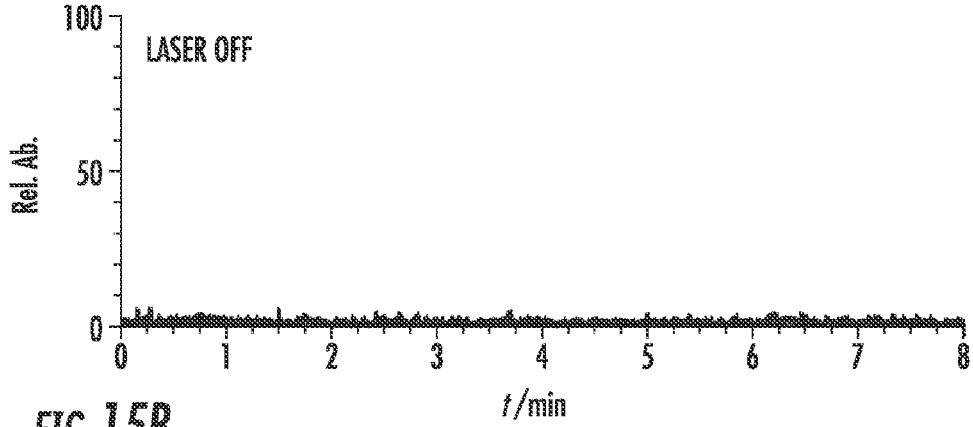

FIG. 15(*a*) shows the relative intensity versus time data from the mass spectrometer, which demonstrates that the HPLC separated the two Rhodamine forms. Peak 1 corresponds to rhodamine B, while Peak 2 corresponds to rhodamine 6G. FIG. 15(*b*) shows a control where the laser beam was not applied to the target site. This data clearly demonstrates the efficacy of the laser desorption technique for the small sample size analysis described herein.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

What is claimed is:

1. A system for extracting an analyte from a specimen, comprising:

a specimen stage comprising a desorption region that is transparent to a radiation wavelength (λ);

a sampling probe for delivering a solvent to a position above said specimen stage, for statically suspending the solvent above said specimen stage, and for removing the solvent from the specimen stage; and a laser source for emitting a laser beam centered at said radiation wavelength (λ) toward said specimen stage, wherein said laser source and said sampling probe are on opposite sides of a primary surface of said specimen stage.

2. The system according to claim 1, further comprising a focusing lens between said laser source and said specimen stage for focusing said laser beam.

3. The system according to claim 1, further comprising: an analytical instrument for determining a chemical composition of an analyte in a testing solution comprising said solvent.

4. The system according to claim 3, wherein said solvent is in fluid communication with said analytical instrument.

5. The system according to claim 3, wherein said analytical instrument is a mass spectrometer, an ionization source, a separation method, or a combination thereof.

6. The system according to claim 1, further comprising a stepper mechanism configured to sequentially direct said laser beam at a plurality of target sites of a specimen supported by said specimen stage.

7. The system according to claim 6, wherein said stepper mechanism is further configured to provide relative motion between said specimen stage and said sampling probe.

8. The system according to claim 7, further comprising a testing device, wherein said stepper mechanism is configured (i) to sequentially position said sampling probe to capture an analyte that is laser desorbed from each of a plurality of target sites with a suspended solvent to form a testing solution and (ii) to discharge said testing solution to said testing device.

9. The system according to claim 8, wherein said testing solution is discharged from a distal end of said sampling probe.

10. A method of extracting an analyte from a specimen, comprising:

providing a specimen supported by a desorption region of a specimen stage;

desorbing an analyte from a target site of a specimen with a laser beam centered at a radiation wavelength (λ); and delivering a solvent to a position above the specimen stage, statically suspending the solvent above the specimen stage, capturing said desorbed analyte with the statically suspended solvent to form a testing solution, and removing the testing solution from a position above the specimen stage, wherein said delivering, suspending, and removing steps are performed with a sampling probe, and wherein said desorption region is transparent to said radiation wavelength (λ), and wherein said specimen and a laser source emitting said laser beam are on opposite sides of a primary surface of said specimen stage.

11. The method according to claim 10, further comprising analyzing a chemical composition of said desorbed analyte.

12. The method according to claim 11, further comprising:

repeating the desorbing, capturing and analyzing steps for each of a plurality of target sites of said specimen.

13. The method according to claim 12, further comprising plotting a property of a chemical component for each of said plurality of target sites.

* * * * *